United States Patent [19]

Covert

[11] 4,027,781

[45] June 7, 1977

[54] PRIMER FEED CARTRIDGE

[76] Inventor: John S. Covert, 320 E. Nettleton, Independence, Mo. 64050

[22] Filed: Mar. 17, 1976

[21] Appl. No.: 667,511

[52] U.S. Cl. ..... 221/105; 86/37

[51] Int. Cl.² ..... B65H 3/32

[58] Field of Search ..... 221/91, 2, 103, 4, 104, 221/5, 105, 133, 188, 189, 197; 206/538, 379, 535, 536, 537; 133/4; 86/23, 37, 45

[56] References Cited

UNITED STATES PATENTS

| | | | |
|---|---|---|---|
| 2,919,796 | 1/1960 | Pressl | 206/379 X |
| 3,358,818 | 12/1967 | Davis | 206/536 |
| 3,848,771 | 11/1974 | Shreev | 221/105 |

*Primary Examiner*—Stanley H. Tollberg
*Attorney, Agent, or Firm*—Fishburn, Gold & Litman

[57] ABSTRACT

A primer container for automatically feeding primer caps into a hand operated tool for reloading spent shells and cartridges. The container comprises a substantially cylindrical body having a first cap fixedly attached to one end thereof and a second cap rotatably mounted to the other end thereof. A storage magazine member disposed within the container includes a plurality of mutually parallel, elongated, cylindrical receptacles spaced radially equidistantly from the central axis of the body. Each receptacle includes cylindrical side walls adapted to receive and retain therein a plurality of primer caps stacked in an end-to-end fashion. The second closure cap includes a centrally apertured dispensing spout for selected rotational registry with the storage member receptacles and is adapted for gravitationally transmitting the primer caps from the container to a work station of the shell reloading device. The container has a removable closure for handling and shipping, which closure is removed and replaced by said second closure cap.

3 Claims, 5 Drawing Figures

PRIMER FEED CARTRIDGE

This invention relates generally to article dispensing devices, and more particularly to primer cap feed mechanism.

Shell loading devices for reloading used shotgun and rifle shells by hand loaders, typically include a structure for replacing the spent primer with a new primer, containing a small amount of highly explosive powder charge. Each new primer must be delivered individually and in a selected orientation to the shell loader, wherein the cap is pressed into a previously formed recess in the shell's flanged end. Conventional reloading devices employ an elongated, upstanding primer feed tube which must be hand loaded by the user. Because of the relatively small size of these primers, handling same in a safe and cleanly manner is an extremely tedious and time consuming task.

The principal objects of the present invention are: to provide a primer container which replaces the conventional primer feed tube of a shall reloader and is adapted to deliver primers in a predetermined orientation, to a pressing work station of said device without the physical handling thereof; to provide such a container wherein a cylindrical body and an apertured magazine member disposed therein, compactly and efficiently store a plurality of primers in a safe, cleanly, and dry environment; to provide such a container that serves as a shipping and storage container for primer and has a removable end cap that is replaced by an apertured end cap for use with a reloader; to provide such a container wherein a centrally apertured dispensing spout is attached to the body for selected rotational registry with the magazine member receptacles or apertures and is adapted for reliably transmitting primer caps from the container to the shell reloading device; to provide such a container wherein the magazine member is comprised of a plurality of tangententially interconnected cylinders for the rigid and safe containment of said primers; to provide such a container wherein the dispensing cap is removable from said container and an imperforate cap is sealingly replaceable thereon for the dry, clean storage of said primers; to provide such a container wherein a retainer pin is inserted through a transverse aperture in said spout to prevent the inadvertent transmittal of primer caps from the container; to provide such a container wherein same is commercially disposable and adapted to engage an insert portion of said reloading device so as to replace standard magazine tube member thereof; and to provide such a container which is economical to manufacture, efficient in use and capable of long operating life and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features of the apparatus.

Figure 1:
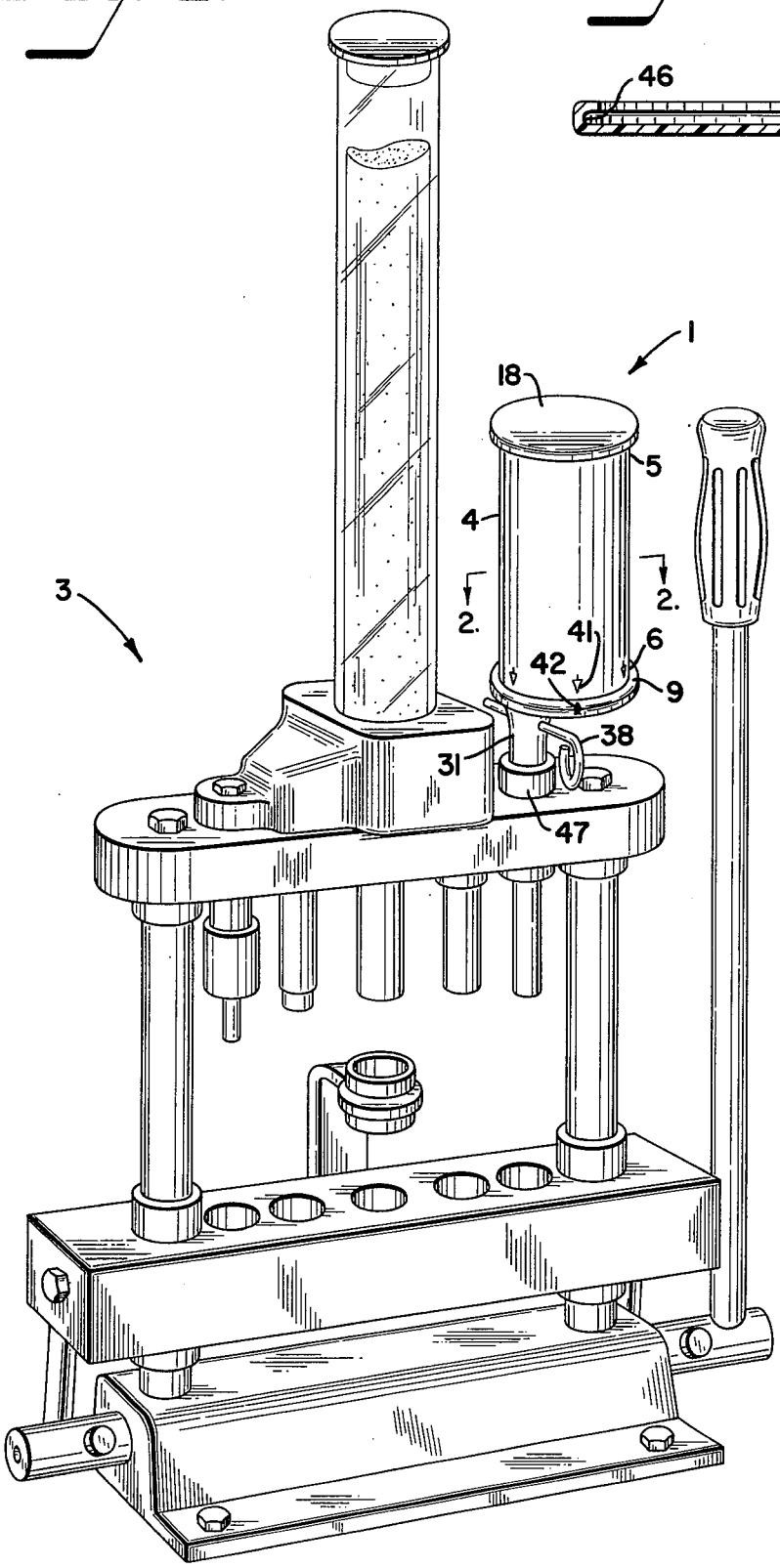
FIG. 1 is a perspective view of a container embodying the present invention, attached to a typical shell reloading device.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates a primer container for automatically feeding primer caps 2 into a shell reloading device 3. The container is a positive mechanical feed mechanism and comprises a cylindrical body 4 having a closed end 5 and a dispensing end 6. A storage magazine member 7 is disposed within said container 1 in a carrousel fashion and includes a plurality of mutually parallel elongated cylindrical apertures or receptacles 8 spaced radially equidistantly from the central axis of the body 4, each receptacle being adapted to receive therein a plurality of primers 2 stacked in an end-to-end fashion. A dispensing closure cap 9 is rotatably mounted to the body dispensing end 6 and is adapted for selected rotational registry with the storage member receptacles 8 for gravitationally transmitting the primers 2 from the container 1 to the shell reloading device 3. The container is particularly adapted for the packaging and shipping or otherwise handling of primers with one end of the body having a closure fixed thereon and the other end having a removable closure. At the time of use, the removable closure 9 is removed from the dispensing end 6 and applied to the body member 4 for use in dispensing primers during reloading operations.

The primer cap 2 includes a casing member 10, percussion composition 11 disposed within said casing member and a primer anvil 12 disposed at the concave end of said primer. The disc-shaped primer 2 is pressed into a recess 13 disposed in the exterior, flanged end 14 of the spend shell 15. The recess 13 is interconnected with the interior 16 of the shell by a vent 17, through which said primer 2 initiates the explosion of the shell's powder.

The cylindrical body 4 has a first closure cap 18 fixedly attached to the body closed end 5 and a second closure or feeder cap 9 rotatably mounted to the body dispensing end 6. In the illustrative structure, the body 4 includes an exterior circumferential rim 20 disposed at the dispensing end 6 thereof for mating contact with a collar portion 21 of rotatable closure cap 9. Closure cap 18 being fixed to the body 4 to insure proper primer orientation therein, is attached to said body by conventional fastening means or, as illustrated, formed integrally therewith.

The cylindrical magazine member 7 disposed within the container 1 includes a plurality of mutually parallel cylindrical receptacles 8 spaced radially equidistantly from the central axis of the body 4. Each of the receptacles 8 has a diameter slightly larger than that of the primer 2 and is adapted to slidingly receive therein a plurality of primers stacked in an end-to-end fashion. The body 4 and magazine member 7 can be formed integrally such as by the extrusion of a synthetic resin material, or the like. In the illustrated structure, the magazine member 7 comprises a plurality of cylindrical tubes 23 having side walls 24 and end portions 25 and 26. The tubes 23 extend between the first and second closure caps 18 and 9, having the ends 25 and 26 thereof respectively adjacent thereto. Each of the tubes 23 tangentially abuts an interior surface 27 of the body 4 along a line 28 and two oppositely adjacent tubes along a line 29, in a bundled fashion, thereby retaining the positioning of the tubes within the container and maximizing storage efficiency. The tubes 23 are preferably interconnected along the lines 20 by means such as an adhesive, heat fusing, ultrasonic welding, or the like. Similarly, the tubes 23 are preferably connected to the interior surface 27 of the body along lines 28 by similar fastening means, thereby increasing the rigidity of the structure and facilitating the indexing thereof for dispensing purposes.

The rotatable closure cap 9 comprises a flat circular portion 30, a peripheral collar portion 21 attached substantially perpendicularly thereto, and a centrally apertured dispensing spout 31 for transmitting the primers 2 to the shell reloading device 3. The closure flat portion 30 overlies the tube ends 26 and, as illustrated, includes integrally formed collar portion 21 having a circumferential groove 32 which mates with rim 20 for cooperating sliding, rotational contact therewith. The body 4 is readily, manually rotatable relative to the second closure cap 9, and the frictional contact between rim 20 and groove 22 retains said members in any user-disposed angular position. Closure cap collar portion 21 preferably includes a radially flexible and resilient portion for removably attaching same to the container body 4.

The dispensing spout 31 includes a circular central aperture 33 extending through closure cap 9, having a diameter slightly larger than that of primer 2, and being disposed radially equidistantly with apertures 8 for selected rotational registry with said storage member receptacles. In the illustrated structure, spout 31 includes a first tapered portion 34 adjacent integrally formed spout end 35 for smooth primer flow, and a second externally tapered portion 36 adjacent the spout's free end 37 to facilitate the connection of the container with the shell reloading device 3. A portion of the spout free end 37 is, in this example, flexible and resilient to facilitate frictional engagement with said shell reloading device.

The container 1 includes a retainer pin 38 which is removably insertable through a transverse aperture 39 in spout 31 adjacent the first tapered portion 34. The pin 38, which is illustrated as having a finger grasping portion 40, blocks the spout aperture 33 when inserted therethrough and frictionally retained therein, and thereby prevents the inadvertent flow of primers from the container. Indexing indicia 41 and 42 are disposed respectively on body 4 and closure cap 9 and provide means for indicating the relative alignment of the central axes of magazine receptacles 8 and the spout aperture 33. In the illustrated structure, the indexing indicia 41 and 42 are respectively positioned on the exterior circumferential surfaces of the body dispensing end 6 and the rotatably cap collar 21, to provide an accurate and easily manipulatable means for dispensing the primers from the container 1.

Figure 5:
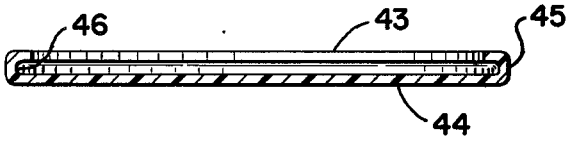
FIG. 5 is a vertical cross-sectional view of an imperforate container cap.
Figure 2:
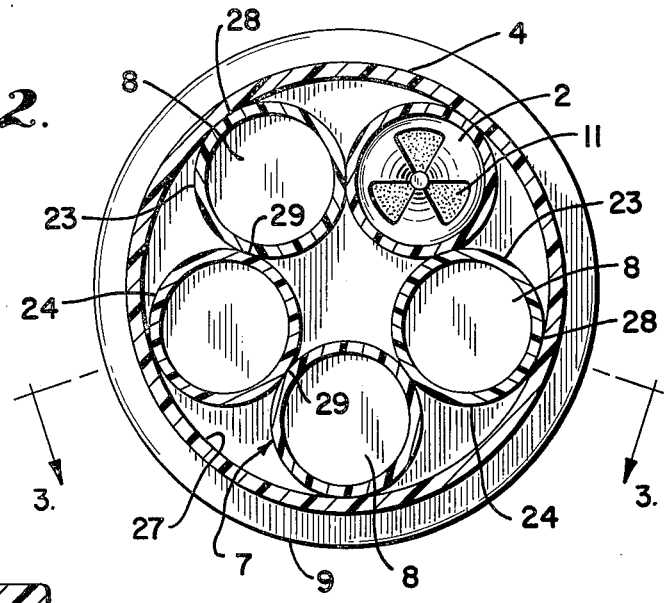
FIG. 2 is a horizontal cross-sectional view of the container taken along line 2—2, FIG. 1.
Figure 3:
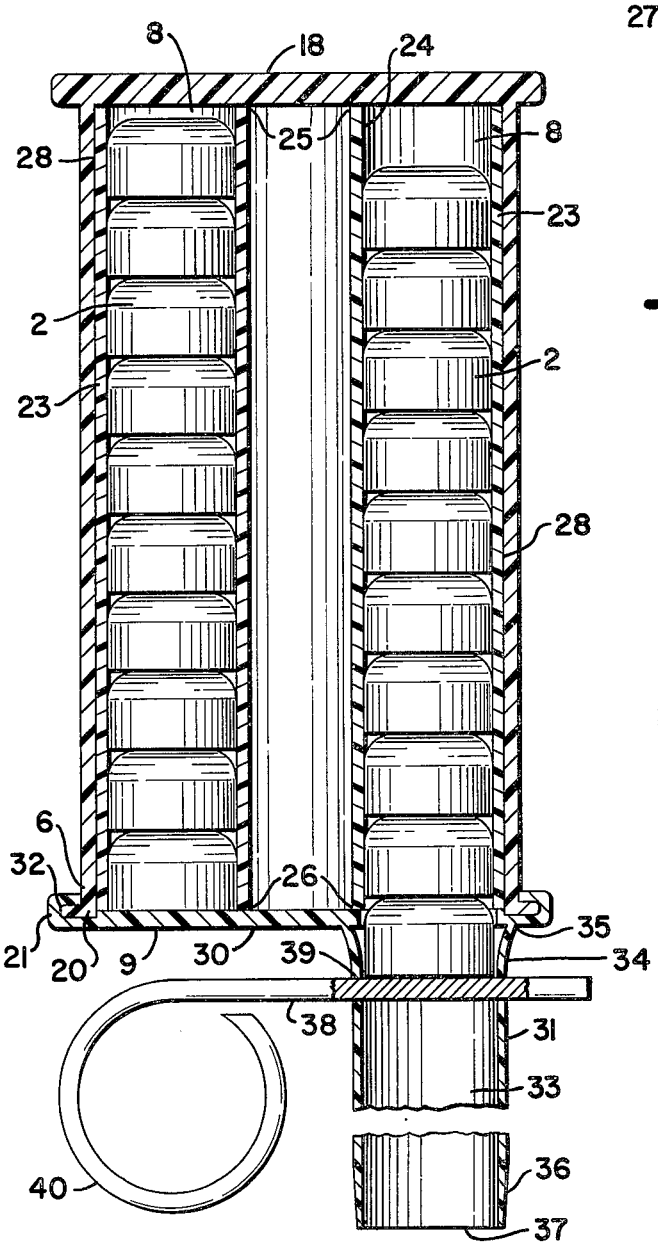
FIG. 3 is a vertical cross-sectional view of the container taken along line 3—3 of FIG. 2 and includes a plurality of primers disposed therein.
Figure 4:
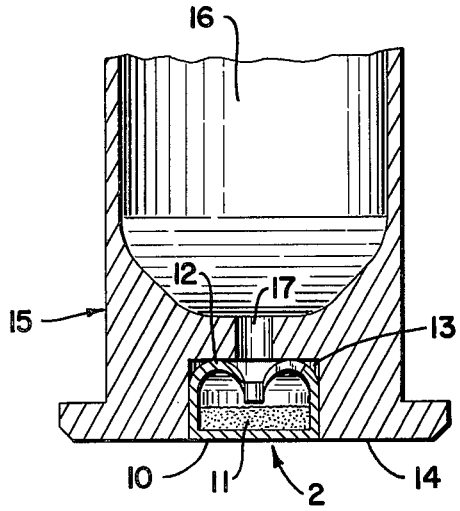
FIG. 4 is a vertical cross-sectional view of a shell and a primer cap pressed therein.

An imperforate third closure cap 43 is adapted to sealingly and removably engage the body dispensing end 6 for the storage and transportation of the primers 2. In the illustrated structure (FIG. 5), the cap 43 is substantially identical to the second closure cap 9 but without spout 31 thereon. Closure cap 43 includes a flat circular portion 44 and a collar portion 45 having a circumferential groove 46 therein for mating contact with body rim 20. A portion of the collar 45 is preferably flexible and resilient to facilitate the removal and replacement of the cap.

In use, a plurality of primers are placed end-to-end into each magazine receptacle 8 in a secure and cleanly manner by a primer manufacturer, packager, or the like. The primer anvils 12 are thereby reliably orientated in a predetermined fashion, as in the illustrated structure, typically with each anvil facing the fixed closure cap 18. The third closure cap 43 is removably and sealingly attached to the body dispensing end 6 for transporting and storing the container. When the user wishes to load shells or cartridges, the third closure cap 43 is removed from the body 4 and the rotatable second closure cap 9 is placed thereon. The conventional primer feed tube having been eliminated, the tapered portion 36 of the closure cap spout 31 is inserted into an apertured portion 47 of the shell reloading device 3, thereby disposing the container closed end 5 in an upwardly fashion. The user then aligns indexing indicia 41 and 42 so as to cause the primers to gravitationally slide through one of the magazine receptacles 8 into an abutting position with pin 38. Pin 38 is then removed from transverse aperture 39, thereby allowing the primers to flow through the dispensing spout 31 into the shell reloading device 3. To load a second column of primers into the device, the user merely rotates the container body 4 relative to closure cap 9, until a second indexing indicia 41, on the body, aligns with the indexing mark 42 on the cap 9. The column of primers within the second magazine apertures is thereby fed into the shell reloading device. The remaining primers are in this carrousel manner similarly dispensed from the container. The container 1 is removed from the reloading device 3 by first inserting the pin 38 through transverse aperture 39 and then pullingly separating the container therefrom. The rotatable second closure cap 9 is then removed from the body 4 and the imperforate third closure cap 43 is replaced thereon for the clean, dry storage of said primers.

It is to be understood that while I have illustrated and described certain forms of my invention, it is not to be limited to the specific forms or arrangement of parts herein described and shown.

What I claim and desire by Letters Patent is:

1. A primer container for automatically feeding primer caps into a shell reloading tool, said container comprising:

a. a cylindrical body having a closed end, a central axis, and a dispensing end, said body dispensing end includes an interior circumferential rim;

b. a first closure cap fixedly attached to said body closed end;

c. a second closure cap rotatably mounted to said body dispensing end;

d. a storage magazine member disposed within said container and including a plurality of mutually parallel, elongated, receptacles spaced radially equidistantly from the central axis of said body, each of said receptacles having interior cross-sectional dimensions slightly larger than a primer cap dimensions and being adapted to slidingly receive therein a plurality of stacked primer caps;

e. said second cap includes a centrally apertured dispensing spout being disposed therein for selected rotational registry with said storage member receptacles and being adapted for gravitationally transmitting said primer caps from said container to a press portion of said shell reloading tool;

f. said second closure cap includes a flat circular portion and a peripheral collar portion attached perpendicularly thereto, said collar portion having a circumferential groove therein mating with said rim for cooperating, sliding, rotational contact therewith;

g. said second closure cap is removably attached to said body dispensing end;

h. a third imperforate closure cap is removably attached to said body dispensing end when said second closure cap is removed therefrom, thereby providing an airtight storage seal for said container; and i. said second and third closure caps respectively include a flexible and resilient portion for removable attachment to the body dispensing end.

2. A primer container for automatically feeding primer caps into a shell reloading tool, said container comprising:

a. a cylindrical body having a closed end, a central axis, and a dispensing end;

b. a first closure cap fixedly attached to said body closed end;

c. a second closure cap rotatably mounted to said body dispensing end;

d. a storage magazine member disposed within said container and including a plurality of mutually parallel, elongated, receptacles spaced radially equidistantly from the central axis of said body, each of said receptacles having interior cross-sectional dimensions slightly larger than a primer cap dimensions and being adapted to slidingly receive therein a plurality of stacked primer caps;

e. said second cap includes a centrally apertured dispensing spout being disposed therein for selected rotational registry with said storage member receptacles and being adapted for gravitionally transmitting said primer caps from said container to a press portion of said shell reloading tool;

f. said storage magazine member comprises a plurality of tubes extending between said first and second closure caps;

g. said tubes include at least one open end disposed adjacent said second closure cap;

h. each of said tubes tangentially abuts said body and two other adjacent tubes thereby retaining the positioning of same within said container;

e. each of said tubes, having two open ends, is tangentially connected with said body and with said two adjacent tubes;

j. indexing means having a first and second members, is respectively disposed on said body and on said second closure cap, for indicating the relative alignment of said magazine member apertures and said dispensing spout central aperture;

k. said body dispensing end includes an exterior circumferential rim; and l. said second closure cap includes a flat circular portion and a peripheral collar portion attached normally thereto, said collar portion having a circumferential groove therein mating with said body end rim for sliding rotational contact therewith.

3. In combination, a plurality of primer caps for reloading shells and a container therefor, said combination comprising:

a. a cylindrical container body having a closed end, a central axis, and a dispensing end;

b. a first closure cap fixedly attached to said body closed end;

c. a second closure cap rotatably mounted to said body dispensing end;

d. a storage magazine member disposed within said container and including a plurality of mutually parallel, elongated, receptacles spaced radially equidistantly from the central axis of said body, each of said receptacles having interior cross-sectional dimensions slightly larger than a primer cap dimensions and slidingly receiving therein a plurality of stacked primer caps;

e. said second cap includes a centrally apertured dispensing spout being disposed therein for selected rotational registry with said member receptacles and gravitationally transmitting said primer caps from said container to a press portion of said shell reloading tool;

f. said body dispensing end includes an exterior circumferential rim; and g. said second closure cap includes a flat circular portion and a peripheral collar portion attached normally thereto, said collar portion having a circumferential groove therein mating with said body end rim for sliding rotational contact therewith.

* * * * *